US005442821A

United States Patent [19]

Weeks

[11] Patent Number: 5,442,821

[45] Date of Patent: Aug. 22, 1995

[54] PATIENT TRANSFER SLING

[76] Inventor: Carole G. Weeks, 117 Boswell Dr., Holly Hill, Fla. 32117

[21] Appl. No.: 116,335

[22] Filed: Sep. 3, 1993

[51] Int. Cl.[6] ..... A61G 7/10

[52] U.S. Cl. ..... 5/81.1; 5/89.1; 5/627; 5/925; 5/926

[58] Field of Search ..... 383/18, 107; 229/186; 5/81.1, 89.1, 625, 627, 925, 926; 224/157, 158; 294/152

[56] References Cited

U.S. PATENT DOCUMENTS

| | | | |
|---|---|---|---|
| 722,456 | 3/1903 | Reeves | 5/627 |
| 879,335 | 2/1908 | Southmayd | 5/627 |
| 1,328,832 | 1/1920 | Hanrath | 5/89.1 |
| 1,938,478 | 12/1933 | Bailer | 383/18 |
| 2,279,694 | 4/1942 | Martinson | 5/627 |
| 2,846,699 | 8/1958 | Watson | 224/158 |
| 3,708,810 | 1/1973 | Merikallio | 5/625 |
| 3,829,914 | 8/1974 | Treat | 5/625 |
| 4,124,908 | 11/1978 | Burns et al. | 5/627 |
| 4,736,474 | 4/1988 | Moran et al. | 5/627 |
| 4,872,226 | 10/1989 | Lonardo | 5/81.1 |
| 5,150,487 | 9/1992 | Hemphill | 5/627 |
| 5,189,746 | 3/1993 | Horie | 5/627 |

FOREIGN PATENT DOCUMENTS

| | | | |
|---|---|---|---|
| 505103 | 8/1954 | Canada | 5/627 |
| 2672 | 11/1918 | Netherlands | 5/627 |
| 468336 | 7/1937 | United Kingdom | 5/625 |
| 03431 | 8/1985 | WIPO | 5/625 |

*Primary Examiner*—Michael J. Milano
*Attorney, Agent, or Firm*—Notaro & Michalos

[57] ABSTRACT

A sling for patient to be transferred includes a trough of strong flexible sheet material having a bottom, opposite side walls and opposite end walls. The side walls are connected to the end walls at four corners with a reinforced edge extending along the side walls, end walls and around the four corners. A pair of flexible handle straps are connected to each of the side walls, each handle strap extending beyond the reinforced edge of each side wall and being adjacent one of the corners and a further handle strap is fixed to each of the end walls, each further handle strap being intermediate the corners of each end wall respectively and extending beyond the reinforced edge of each end wall.

16 Claims, 2 Drawing Sheets

PATIENT TRANSFER SLING

FIELD AND BACKGROUND OF THE INVENTION

The present invention relates in general to carrying devices for patients, invalids, injured persons or others not capable of moving themselves, and in particular to a new and useful, one-piece, flexible sling for moving the persons from one location to another.

The present invention is the subject of Disclosure Document Number 331631 filed in the United States Patent and Trademark Office on May 25, 1993.

U.S. Pat. No. 3,859,677 discloses an invalid carrying sling having fabric portions, a belt structure for engagement around the waste of a patient, and rigid carrying rods attached to the flexible portions for carrying an invalid.

A sling made entirely of flexible materials is disclosed in U.S. Pat. No. 4,723,327. The sling comprises a broad rectangular area having handles at all four corners for use in lifting a patient. A lifting vest is disclosed in U.S. Pat. No. 4,159,010 which is in the form of a garment that has areas which can be grasped by persons other than the wearer, to lift the person. Lifting sheets for transferring patients are also known. See for example U.S. Pat. Nos. 5,148,558 and 5,155,874.

U.S. Pat. No. 4,944,057 discloses a flexible sling structure having a plurality of handles and formable into a concave structure for engagement around the bottom of a person to be moved and manipulatable by one aid to lift the person to be moved.

Despite the foregoing advancements in this field, a need remains for a simple, flexible, inexpensive sling for transporting invalids, patients, injured persons or others needing assistance, which is simple and intuitive to use, easily stored in a very small volume when not in use, and readily available to all who may need such a sling in a hospital environment, nursing home, emergency vehicle, home use or even for field use in a back-pack, or for storage in an automobile.

SUMMARY OF THE INVENTION

An object of the present invention is to provide a sling made entirely of flexible material which has strategically located handles, a particularly utilitarian shape and configuration, an appropriate reinforcement and limited fluid resistance to be highly useful for transporting invalids, patients, injured persons and the like.

The sling of the invention comprises a trough of strong flexible sheet material having a bottom, opposite side walls and opposite end walls, the side walls being connected to the end walls at four corners. A reinforced edge extends along the side walls, end walls and around the four corners and a pair of flexible handle straps are connected to each of the side walls, each handle strap extending beyond the reinforced edge of each side wall and being adjacent one of the corners. A further handle strap is fixed to each of the end walls, each further handle strap being intermediate the corners of each end wall respectively and extending beyond the reinforced edge of each end wall.

According to another useful feature of the invention, the sheet material is "ripstop"nylon having an outer water-resistant, for example, urethane coating, for added durability and moisture resistance.

Advantageously, each of the handle straps is in the form of a loop with the handle straps at the side walls having one leg extending as a reinforcing band down the side wall and across the bottom. The band, and the reinforced edge around the side walls and end walls, is advantageously made of multiple, for example, four layers of the ripstop material comprising the bottom, side and end walls.

For simplicity of construction, the trough has triangular gussets at each corner, preferably sewn at the end walls, so that the trough can be sewn from an originally flat sheet of flexible material.

A further object of the present invention is to provide a transfer sling which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which an embodiment of the invention is illustrated.

DESCRIPTION OF THE PREFERRED EMBODIMENT

Figure 1:
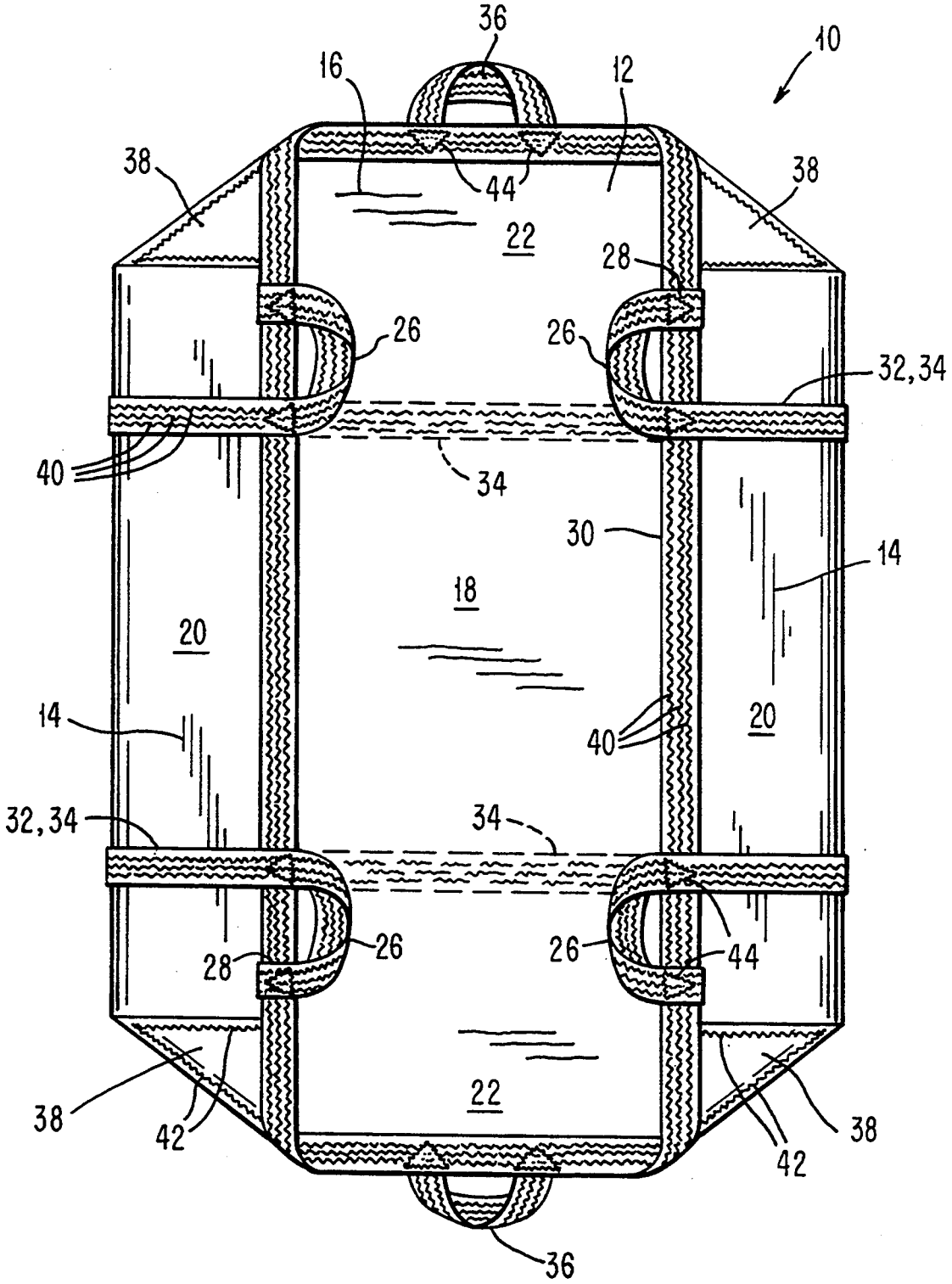
FIG. 1 is a top plan view of the patient transfer sling of the present invention, in a flattened condition.
Figure 2:
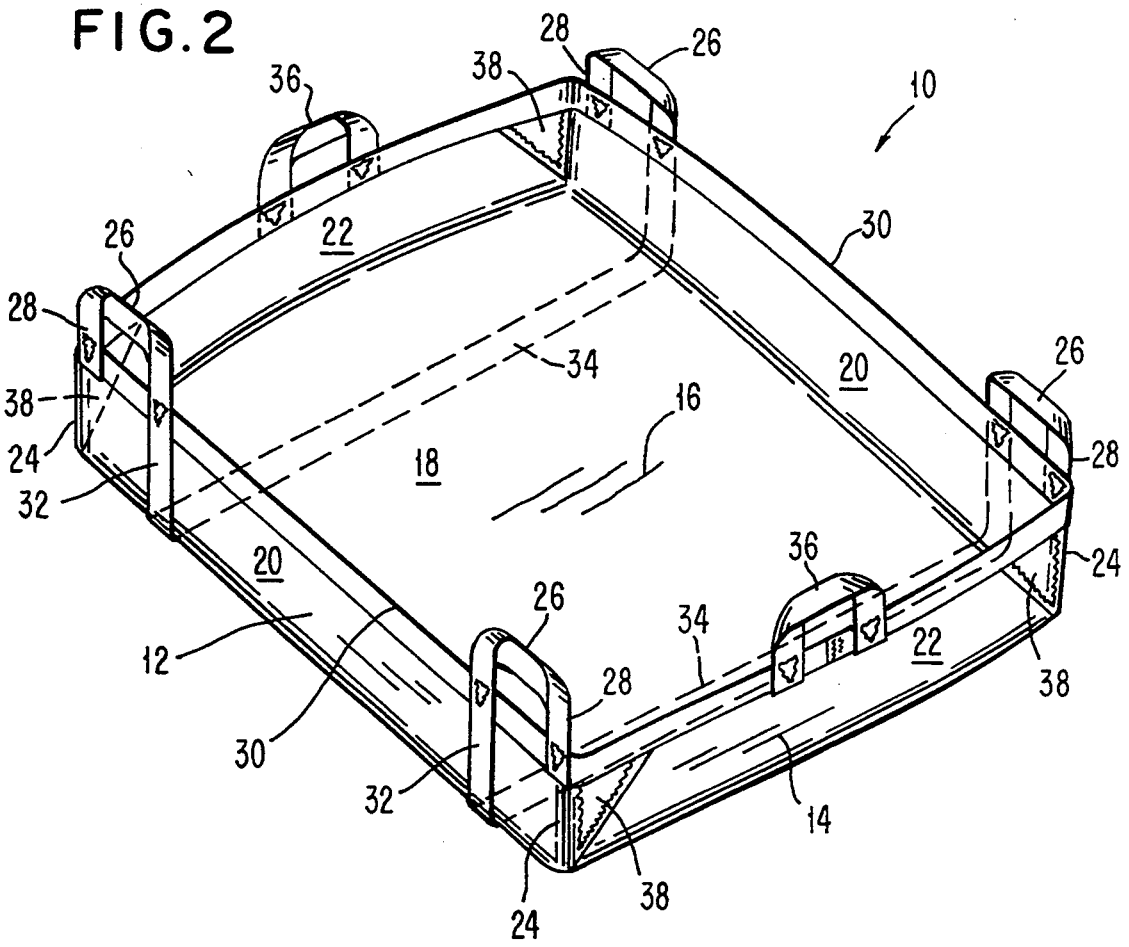
FIG. 2 is a perspective view of the sling in an open position.

Referring to the drawings in particular, the invention embodied in FIGS. 1 and 2 comprises a patient transfer sling generally designated 10 and comprising a one-piece trough 12 made of strong, flexible, somewhat moisture resistant sheet material such as 100% nylon "ripstop" material having a dull non slippy inner surface 16 and a shiny, more water resistant and slipperier outer surface 14, made for example by urethane coating the nylon material. This is important to help slide the patient in the sling from place to place more easily, to resist abrasion and wear, and to have some water-resistance. The dull inner surface preventing the patient from sliding out of sling while being moved. In the position for use best shown in FIG. 2, the trough 12 is configured to have a bottom or bottom wall 18, a pair of opposite side walls 20 and a pair of opposite end walls 22 which are connected to the side walls at four corners 24.

A pair of handle straps 26 is connected to each of the side walls 20, adjacent respective corners 24. Each handle strap 26 is loop-shaped and extends beyond a reinforced edge 30 that extends along the side walls, the end walls and around each corner.

Each handle strap 26 has a short leg 28 which overlaps and is sewn to the reinforced edge 30, and a long leg 32 which is sewn to the reinforced edge 30 but extends as a reinforcing band or strap 34, along the outer surface of side walls 20 and across the outer surface of bottom wall 18.

A further handle strap 36 is connected to each of the end walls 22, is sewn to the reinforced edge 30 and extends beyond the edge 30 as shown in FIGS. 1 and 2.

By strategically positioning handle straps 26 and 36 near the corners of the trough and near the middle of each end wall 22 respectively, the light weight, strong and durable trough can enable a person to move a patient painlessly and with the aid of only one or two people, depending on the weight of the person to be moved.

The sling of the invention can be used, for example, with a transfer board to slide the patient from a wheelchair into and out of an automobile, another chair or the like. The trough can also have different sizes for children or adults and for persons that have suffered one or two leg amputations. The trough is also usable with the person either in the sitting or laying down positions.

For an average adult, each side wall 20 and each end wall 22 extends six inches from the bottom wall 18. Each corner 24 is formed by a triangular gusset which is folded from an initially flat sheet of flexible material. Advantageously, the gussets shown, for example, at 38, are sewn at the outer surface of end walls 22 to avoid interference with attachment of the side wall handles 26 and to provide additional reinforcement under the reinforcing edge 30. Bands 34 are designed to give additional lifting strength. Gussets 38 are designed to give cocoon fit to sling and help prevent patient from sliding out.

Edge 30, handles 26 and 36, and reinforcing strap 34, are all advantageously made of four layers of the same ripstop material forming the trough 12, and sewn together with three parallel zigzag stitches shown, for example, at 40 in FIG. 1. Zigzag stitches 42 are also used at the gussets 38 and in a triangular pattern 44 for attaching each handle leg to the reinforced edge 30. The use of zigzag stitching throughout increases the strength of the sling without substantially increasing weight or volume.

The sling, thus, can be conveniently folded into a very small package and kept for emergency or routine use, for example, in a back-pack, a glove compartment in an automobile, in a pouch at the foot or head of a hospital bed, in a pouch attached to a gurney, etc.

The sling is engaged under a patient by folding the sling in half and sliding it under the patient. Then the other half is pulled through on the other side, either with the patient in the prone position or by rolling the patient.

Figure 3:
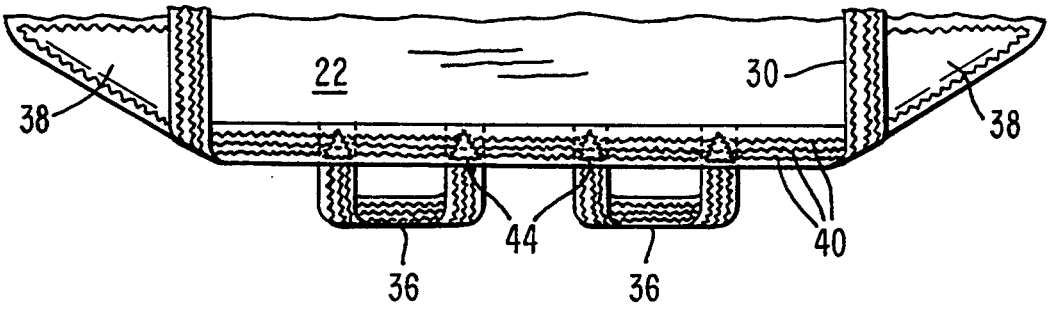
FIG. 3 is a partial view of another embodiment of the invention.

FIG. 3 shows another embodiment of the present invention with both opposite ends 22 (only one end shown in FIG. 3), rather than having a single end handle 36 as shown on FIG. 1, has side-by-side handles 36. A pair of handles has been found advantageous where two people are attempting to lift the patient. With the embodiment of FIG. 1 both people tend to reach for the single handle 36. By providing two handles 36 as shown in FIG. 3, the operation becomes much more convenient.

Advantageously, the handles, reinforcing edge and strap are $1\frac{1}{2}$ inches across, and for an adult, the bottom can be $30\times30$ inches square.

Other sizes are also possible, however.

To manufacture the present invention, a square sheet of ripstop fabric $3\frac{1}{2}\times3\frac{1}{2}$ feet square can be used. Handle strips can be made of sheets of fabric that are 6 inches wide and $11\frac{1}{2}$ inches long. Straps 34 can be additional strips of fabrics 6 inches wide and 5 feet long with the strip making up reinforcing edge 30 being 6 inches wide and $10\frac{1}{2}$ feet long.

A large size sling, for example, made of ripstop material of contrasting color, can have a body manufactured of sheet material 4 feet 4 inches by 4 feet and 7 inches in area, with the support bands 34 being made of 6 inch wide fabric having a 5 foot 10 inch length. The border strip is also appropriately longer, for example, 6 inches wide and 13 feet and 10 inches long.

The four layers of fabric for handles 26, 36, strap 38 and edge 30, are achieved for the handles and reinforcing edge and band by folding the fabric over on itself to achieve the $1\frac{1}{2}$ inch width in the sewn condition.

It is noted that the relative width to length size of the embodiment of FIGS. 1 and 2 is particularly suited for double leg amputees. It can also be used for a seated patient.

For prone patients, the dimension from end 22 to end 22 is lengthened to correspond approximately to the height of the patient (that is generally either to the height of an average adult or the height of an average child depending on for whom the sling is being made). In likewise fashion, the width from side 20 to side 20 can be adjusted to be narrower where thinner people are to be moved or wider where wider people are to be moved.

Although the preferred embodiment of the invention is made of ripstop nylon material, vinyl or other fabrics may also be used as long as light weight, flexible and strong construction can be achieved. The handles 26 and 36 can be padded or corded if desired.

While the specific embodiment of the invention have been shown and described in detail to illustrate the application of the principles of the invention, it will be understood that the invention may be embodied otherwise without departing from such principles.

What is claimed is:

1. A transfer sling for patients comprising:

a trough of strong flexible sheet material having a bottom, opposite side walls and opposite end walls, said side walls being connected to said end walls at four corners, said side and end walls and said corners all extending substantially the same distance upwardly from the bottom to form the trough;

a reinforced edge extending along said side walls, end walls and around said four corners, said reinforced edge being spaced upwardly from the bottom;

a pair of flexible handle straps connected to each of said side walls, each handle strap extending beyond the reinforced edge of each side wall and being adjacent one of said corners; and a further handle strap fixed to each of said end walls, each further handle strap being intermediate the corners of each end wall respectively and extending beyond the reinforced edge of each end wall.

2. A sling according to claim 1, wherein each of said first mentioned and further handle straps are loop-shaped and have a pair of legs fixed to the reinforced edge.

3. A sling according to claim 2, including a reinforcing band connected to one leg of each handle strap connected to each side wall, each band extending along each side wall and across the bottom.

4. A sling according to claim 3, wherein each band is mounted on an outer surface of the side walls and bottom.

5. A sling according to claim 4, wherein the inner surfaces of the side walls, end walls and bottom are dull and the outer surfaces of the side walls, end walls and bottom are shiny.

6. A sling according to claim 5, including a triangular gusset adjacent each corner.

7. A sling according to claim 6, wherein each triangular gusset is sewn to an outer surface of one of the end walls.

8. A sling according to claim 7, wherein the handle straps are attached to the reinforced edge by a plurality of zigzag stitches.

9. A sling according to claim 1, wherein the inner surfaces of the side walls, end walls and bottom are dull and the outer surfaces of the side walls, end walls and bottom are shiny.

10. A sling according to claim 1, wherein each handle strap connected to the side walls has a short leg attached to the reinforced edge and adjacent one of the corners and a long leg attached along the respective side walls and bottom, and spaced away from the corner.

11. A sling according to claim 10, wherein the trough includes a triangular gusset adjacent each corner.

12. A sling according to claim 11, wherein the triangular gussets are sewn at the end walls.

13. A transfer sling for patients comprising:

a trough of strong flexible sheet material having a bottom, opposite side walls and opposite end walls, said side walls being connected to said end walls at four corners;

a triangular gusset adjacent each corner;

a reinforced edge extending along said side walls, end walls and around said four corners;

a pair of flexible handle straps connected to each of said side walls, each handle strap extending beyond the reinforced edge of each side wall and being adjacent one of said corners; and a further handle strap fixed to each of said end walls, each further handle strap being intermediate the corners of each end wall respectively and extending beyond the reinforced edge of each end wall.

14. A sling according to claim 13, wherein each triangular gusset is sewn to one of the end walls.

15. A sling according to claim 13, wherein the handle straps are attached to the reinforced edge by a plurality of zigzag stitches.

16. A sling according to claim 13 including a pair of further handle straps fixed to each of said end walls.

* * * * *